United States Patent [19]

Martin

[11] Patent Number: 4,501,322

[45] Date of Patent: Feb. 26, 1985

[54] HYPER CLEANING CASING BRUSH

[76] Inventor: Edwin L. Martin, P.O. Box 303, Bakersfield, Calif. 93302

[21] Appl. No.: 559,466

[22] Filed: Dec. 8, 1983

[51] Int. Cl.[3] ..... E21B 37/08

[52] U.S. Cl. ..... 166/173; 15/104.2

[58] Field of Search ..... 166/173, 174, 223; 15/194, 104.2; 239/587

[56] References Cited

U.S. PATENT DOCUMENTS

| | | | |
|---|---|---|---|
| 1,342,618 | 6/1920 | Bashara | 166/173 |
| 1,806,073 | 5/1931 | MacGregor | 15/104.2 X |
| 2,145,190 | 1/1939 | Nay | 166/174 |
| 2,228,640 | 1/1941 | O'Neill | 166/223 |
| 3,224,506 | 12/1965 | Huitt | 166/223 |

FOREIGN PATENT DOCUMENTS

| | | | |
|---|---|---|---|
| 549166 | 11/1957 | Canada | 285/39 |

*Primary Examiner*—Stephen J. Novosad
*Assistant Examiner*—Michael Starinsky
*Attorney, Agent, or Firm*—Harvey B. Jacobson

[57] ABSTRACT

A vertically elongated cylindrical and hollow thick-walled body is provided and includes a tubular swivel structure carried by its upper end for removable attachment to a supporting bottom tubing section of a tubing string disposed within a casing to be cleaned. The body includes circumferentially and axially spaced outwardly projecting brushes and circumferentially and axially spaced inwardly retractable spring biased spray nozzles interspersed between adjacent brushes. The body is hollow and includes a closed lower end and the upper end of the body includes a tubular neck extending upwardly into the tubular swivel structure by which the body is to be attached to the associated bottom tubing section. Fluid under pressure to be supplied to the retractable spray nozzles is piped down through the associated tubing string and into the interior of the hollow body for communication with the retractable nozzles. The outer ends of the brushes are spaced greater radial distances from the center axis of the body than the outer extremities of the nozzles, when the latter are in their radial outermost positions.

3 Claims, 7 Drawing Figures

FIG. 1
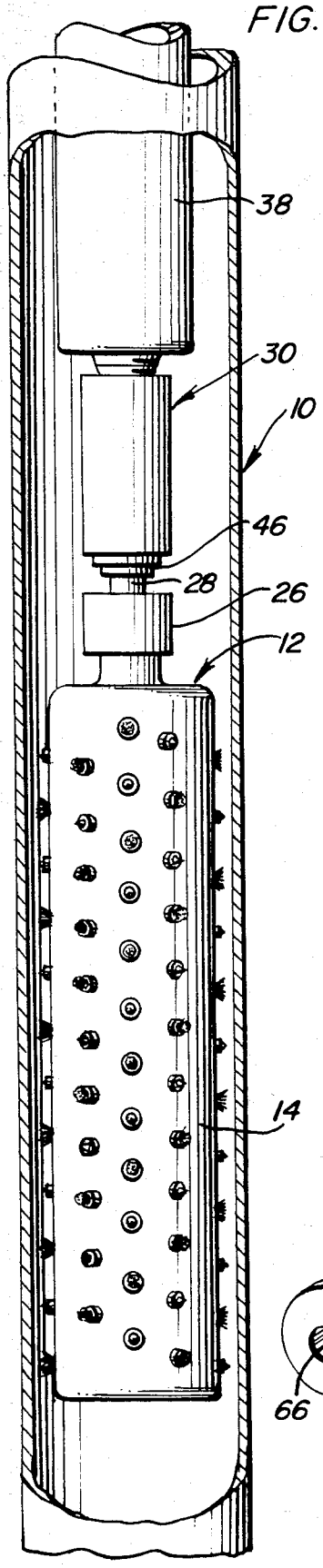
FIG. 5
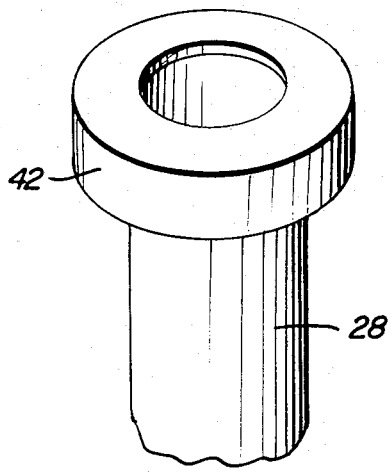
FIG. 6
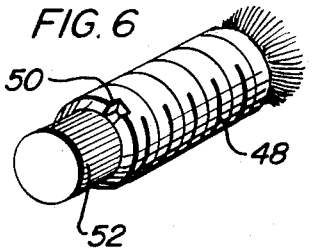
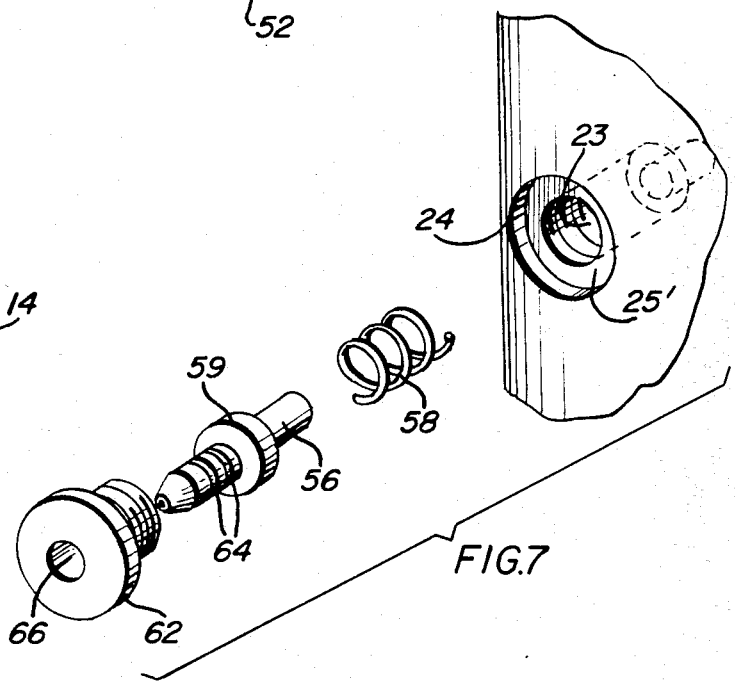
FIG.7

HYPER CLEANING CASING BRUSH

REFERENCE TO RELATED APPLICATIONS

The hyper cleaning casing brush comprises a modification of the Casing Brush disclosed in my co-pending U.S. application, Ser. No. 469,811, filed Feb. 25, 1983, and is designed to perform a similar but more thorough cleaning action on the interior of a perforated associated well casing section.

BACKGROUND OF THE INVENTION

In all water, gas, oil or other types of wells used to draw fluids from the subsurface to the surface a perforated casing is used in the area where fluid is to be extracted and over a period of time, minerals clog up the ports in the perforated casing. Accordingly, a need exists for structure whereby these perforations may be unclogged by machinery operated from the surface whenever the perforations become clogged to an extent adversely affecting the flow of fluid from the well.

Various forms of casing brushes heretofore have been designed including some general structural and operational features of the instant invention. Examples of these previously known forms of brushes are disclosed in U.S. Pat. Nos. 1,342,618, 1,806,073, 2,338,372, 3,176,772, 3,310,113 and 3,827,942. However, these previously known forms of casing brushes, in some instances, do not include brushes which are sufficiently stiff to accoomplish the desired cleaning action or brushes which may be readily replaced. Further, in some cases the inclusion of brushes, alone, are not sufficient to unclog perforations in a perforated casing section.

BRIEF DESCRIPTION OF THE INVENTION

The casing brush of the instant invention is constructed with a swivel whereby the brush may rotate independent of the supporting tubing and wherein the brush elements carried by the casing brush may be readily renewed. Further, the casing brush also includes spray nozzles whereby high pressure jets of cleaning liquid may be directed radially outwardly of the generally cylindrical brush for the purpose of unclogging those casing perforations which may not be fully cleared or unclogged through the utilization of brushes alone. In addition, the spray nozzles are mounted from the cylindrical body of the brush for radial retraction and extension relative thereto between innermost and outermost positions disposed inwardly of and projecting outwardly from the outer periphery of the cylindrical brush body.

The main object of this invention is to provide a casing brush including structural features thereof which will enable the brush to perform a perforation equipped casing section unclogging operation in an efficient manner.

Yet another object of this invention is to provide a casing brush whose brush defining elements may be readily replaced, when desired.

Still another important object of this invention is to provide a casing brush including a swivel whereby rotary movement of the brush will not result in unthreading of any threaded joints supporting the casing brush.

A further object of this invention is to provide a casing brush which may be readily constructed of different sizes for use in different size perforated well casing sections.

A further important object of this invention is to provide a casing brush operable to perform a perforated casing section cleaning operation by brushing action and by spray jet action whereby perforations which may not be readily cleansed by brushing action may be more thoroughly cleansed by the spray jet action of the spray jets of the brush.

Another very important object of this invention is to provide a casing brush including radially outwardly projecting spray nozzles which may closely oppose a perforated casing section wall portion and yet which are mounted for retraction inwardly of the outer periphery of the tubular body of the brush so that lateral forces on one side of the brush will not cause damage to the spray jets on the other side of the brush.

A final object of this invention to be specifically enumerated herein is to provide a well casing brush in accordance with the preceding objects and which which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of the hyper cleaning casing brush of the instant invention illustrated within a casing section having parts thereof being broken away and illustrated in vertical sections;

FIG. 5 is an enlarged fragmentary elevational view of the upper end swivel portion of the casing brush;

FIG. 6 is a perspective view of one of the brush assemblies of the casing brush; and FIG. 7 is an exploded perspective view of one of the retractable spray nozzles of the casing brush.

DETAILED DESCRIPTION OF THE INVENTION

Figure 2:
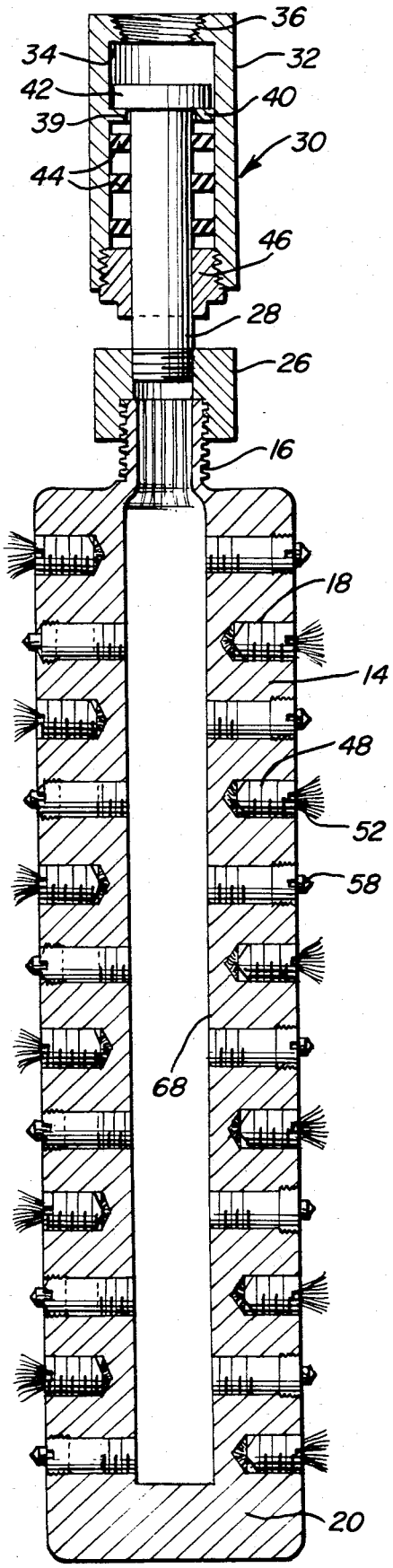
FIG. 2 is an enlarged longitudinal vertical sectional view of the casing brush.
Figure 3:
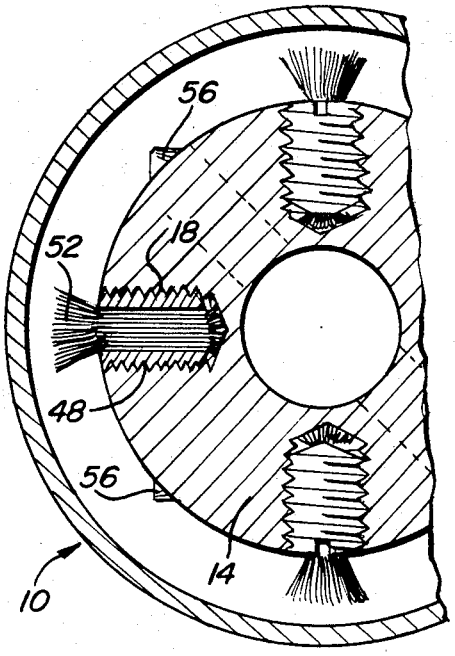
FIG. 3 is a fragmentary enlarged horizontal sectional view of the casing brush disposed within an associated casing section.

Referring now more specifically to the drawings, the numeral 10 generally designates a well casing. The casing brush of the instant invention is referred to in general by the reference numeral 12 and includes an elongated cylindrical and hollow body 14 including upper and lower ends. The upper end of the body 14 includes a diametrically reduced externally threaded neck 16 and the body further includes circumferentially and axially spaced threaded blind bores 18 formed therein as well as a lower end wall 20. In addition, the body 14 also includes peripherally and longitudinally spaced threaded radial bores 22 including first and second outer end counterbores 23 and 24 defining outwardly facing shoulders 25 and 25'.

A tubular coupling member 26 removably couples the upper end diametrically reduced neck 16 of the body 14 to the depending tubular shank portion 28 of a swivel assembly referred to in general by the reference numeral 30. The swivel assembly 30 includes a cylindrical body 32 having an upper end wall 34 provided with a central tapering threaded aperture 36 into which the tapered and externally threaded lower male end of a tubing section 38 may be removably threadedly engaged, see FIGS. 1 and 2. The upper end of the tubular shank portion is rotatably received through an opening 39 formed in a partition 40 secured within the body 32 and the upper end of the tubular shank portion 28 projects above the partition 40 and has a stop collar 42 mounted thereon. A plurality of annular seal rings 44 are disposed within the body 32 about the tubular shank portion 28 below the partition 40 and a coupling sleeve 46 is threaded into the internally threaded lower end portion of the body 32 and rotatably receives the tubular shank portion 28 therethrough. Accordingly, the swivel assembly 30 defines a fluid tight rotary coupling between the tubing section 38 and the body 14.

Each of the blind bores 18 includes an externally threaded tubular sleeve 48 removably threadedly engaged therein and the outer end of each tubular sleeve 48 includes diametrically opposite radial slots 50 formed therein whereby a suitable tool may be used to threadedly engage the sleeves 48 in the corresponding blind bores 18. The sleeves 48 each snugly receive therethrough a twisted strand wire rope section or brush 52 and each section 52 includes an inner end portion which projects outwardly of the inner end of the corresponding sleeve 48 and is tightly seated against the inner end of the corresponding blind bore 18. When the inner ends of the wire rope sections 52 are abutted against the inner ends of the blind bores 18, they are deformed in order to prevent outward withdrawal of the wire rope sections 52 from the tubular sleeves 48. In addition, the outer ends of the wire rope sections 52 project outwardly of the outer ends of the tubular sleeves 48 for brushing engagement with the inner surface of the corresponding casing section 10.

Each of the radial bores 22 has a tubular spray nozzle 56 slidably and rotatably received therein and including a mid-length diametric enlargement 59 loosely slidable within the inner end portion of the corresponding counterbore 23. A compression spring 58 is disposed about each body 56 between the corresponding enlargement 60 and shoulder 25 and each tubular nozzle 56 is retained in position by a centrally bored and shouldered threaded nut 62 threadedly engaged within the outer end of the corresponding counterbore 23. The shoulder of each nut 62 abuts the corresponding shoulder 25' and outward displacement of each tubular spray nozzle 56 is limited by contact of its enlargement 60 with the inner end of the nut 62. Each tubular spray nozzle 56 outer end includes a pair of axially spaced O-rings 64 sealingly and slidingly received in the bore 66 formed through the corresponding nut 62. In their outermost limit positions, the outer extremities of the nozzles 56 are spaced shorter radial distances from the center axis of the body 14 than the outermost ends of the wire rope sections or brushes 52.

Figure 4:
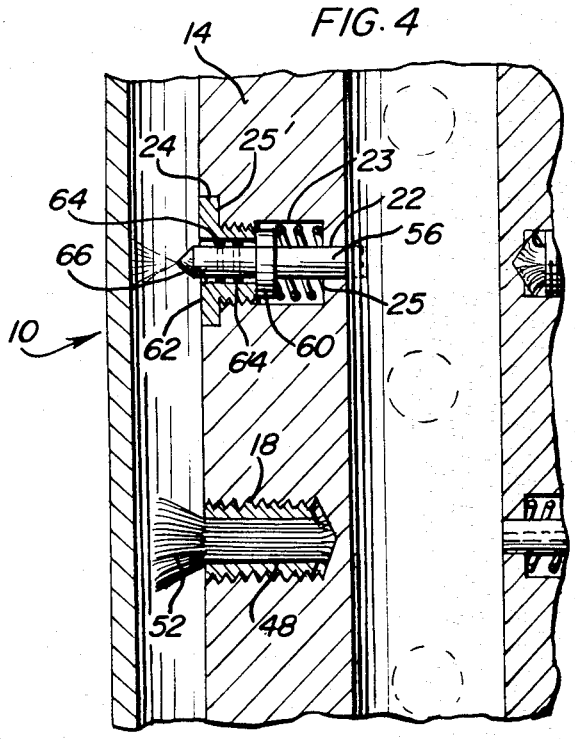
FIG. 4 is a fragmentary enlarged vertical sectional view of the assembly illustrated in FIG. 3.

In an operation, the casing brush is lowered into the casing 10 and may be reciprocated therein. The wire rope sections or brushes 52 are arranged in a spiral pattern extending about the body 14 and vertical reciprocation of the body 14 within the casing 10 with the wire rope sections 52 engaged with the inner surface of the casing 10 may impart rotary motion to the body 14 independent of rotary motion of the tubing section 38. While the body 14 is being reciprocated in the casing 10, fluid under pressure may be pumped downwardly through the bottom tubing section 38 and into the tubular nozzles 56. The tubular nozzles 56 are spring mounted within the bores 22 and may be retracted inwardly from the positions thereof illustrated in FIG. 4 of the drawings to positions at least substantially flush with the outer surface of the body 14. Thus, should the body 14 contact one side of the interior of casing 10, the nozzles 56 on the opposing side of the body 14 may retract inwardly of the body 14 in order to prevent damage to the nozzles 56.

However, while the wire rope strands 52 are capable of performing a hard scrubbing action on the inner surface of the casing 10 as well as a perforated casing section disposed therebelow, the nozzles 56 are capable of discharging high pressure jets of cleansing liquid on the internal surfaces of the casing being cleaned and the high pressure jets of cleaning liquid will serve to clean the residue from the radial outermost portions of perforations formed in the casing which might not be readily cleaned by the wire rope strands 52. It is important that the nozzles 56 project outwardly of the body 14 to at least some extent in order to place the outlet ends thereof as close as possible to the casing surfaces to be cleaned. However, the nozzle 56 are retractable to prevent damage thereto in the event the adjacent outer surfaces of the body 14 contact the opposing inner surface of casing 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A casing brush including a cylindrical, hollow thickwalled body having upper and lower ends, tubular swivel means carried by the upper end of said body for removal attachment to a supporting tubing section, said body including means closing the lower end of the interior thereof, said body including a plurality of circumferentially and axially spaced blind bores formed therein, a plurality of wire brushes, means removably mounting a wire brush from each of said blind bores and with said wire brushes projecting radially outwardly from said body, said body also including circumferentially and axially spaced radial bores, each of said radial bores having a tubular nozzle removably mounted therein, each of said nozzles including an outer discharge end and an inner inlet end, each of said inlet ends being operative to receive fluid under pressure introduced into said tubular body through said tubular swivel means at the upper end thereof, means supporting each of said spray nozzles from said thick-walled body for shifting between a first extended position projecting outwardly of said thick-walled body and a second retracted position at least substantially fully retracted within the outer confines of said thick-walled body, spring means operatively connected between said nozzles and thick-walled body yieldingly biasing said nozzles toward said extended positions, the outer ends of said brushes being spaced greater radial distances from the center axis of said body than the outer extremities of said nozzles, when the latter are in their first extended positions.

2. The casing brush of claim 1 wherein each of said blind bores has a threaded tubular sleeve threadedly engaged therein, each of said sleeves including a wire rope strand snugly received therethrough and including an outer end projecting outwardly of the outer end of the sleeve, the inner end of each wire rope strand projecting inwardly of the inner end of the corresponding sleeve and abutted against and deformed by the closed inner end of the corresponding blind bore, the outer end of each of said tubular sleeves including circumferentially spaced outwardly opening notches formed therein by which a spanner wrench or similar tool may be engaged with the outer end of each tubular sleeve for imparting rotational torque thereto.

3. The casing brush of claim 2 wherein said notches include at least one pair of diametrically opposite generally radial notches.

* * * * *